US010605046B2

(12) United States Patent
Ismail et al.

(10) Patent No.: US 10,605,046 B2
(45) Date of Patent: Mar. 31, 2020

(54) FLOW CONTROL DEVICE

(71) Applicant: Swellfix B.V., Rijswijk ZH (NL)

(72) Inventors: Ismarullizam Mohd Ismail, Aberdeen (GB); Benn Voll, Hundvaag (NO); Steven Fipke, Humble, TX (US); Stephen Lee Crow, Spring, TX (US)

(73) Assignee: Swellfix B.V., Rijswijk (NL)

( * ) Notice: Subject to any disclaimer, the term of this patent is extended or adjusted under 35 U.S.C. 154(b) by 0 days.

(21) Appl. No.: 15/111,660

(22) PCT Filed: Jan. 29, 2015

(86) PCT No.: PCT/EP2015/051832
§ 371 (c)(1),
(2) Date: Jul. 14, 2016

(87) PCT Pub. No.: WO2015/114055
PCT Pub. Date: Aug. 6, 2015

(65) Prior Publication Data

US 2016/0333664 A1 Nov. 17, 2016

Related U.S. Application Data

(60) Provisional application No. 61/945,401, filed on Feb. 27, 2014.

(30) Foreign Application Priority Data

Jan. 31, 2014 (GB) ..... 1401653.9

(51) Int. Cl.
*E21B 34/08* (2006.01)
*E21B 34/10* (2006.01)
(Continued)

(52) U.S. Cl.
CPC ..... *E21B 34/10* (2013.01); *E21B 34/08* (2013.01); *E21B 41/0078* (2013.01); *E21B 43/12* (2013.01)

(58) Field of Classification Search
CPC ..... E21B 34/10; E21B 34/08; E21B 41/0078; E21B 43/12
(Continued)

(56) References Cited

U.S. PATENT DOCUMENTS

2004/0055751 A1 3/2004 McGlothen et al.
2006/0151174 A1 7/2006 Cantin et al.
(Continued)

FOREIGN PATENT DOCUMENTS

WO WO-2012095196 A2 7/2012
WO WO-2013124644 A2 8/2013

OTHER PUBLICATIONS

International Search Report PCT/ISA/210 and Written Opinion of the International Searching Authority PCT/ISA/237 for International Application No. PCT/EP2015/051832 dated Oct. 9, 2015.

*Primary Examiner* — Taras P Bemko
(74) *Attorney, Agent, or Firm* — Harness, Dickey & Pierce, P.L.C.

(57) ABSTRACT

A downhole flow control device includes a body to be secured within a wall of a tubular, wherein the body defines a flow path therethrough, with a nozzle mounted within the flow path. A dissipation structure is positioned on a first side of the nozzle, such that fluid flowing through the body in a first direction will exit the nozzle and impinge on the dissipation structure prior to exit from the flow control device.

37 Claims, 7 Drawing Sheets

(51) Int. Cl.
*E21B 41/00* (2006.01)
*E21B 43/12* (2006.01)

(58) Field of Classification Search
USPC ..... 166/374
See application file for complete search history.

(56) References Cited

U.S. PATENT DOCUMENTS

| | | | | |
|---|---|---|---|---|
| 2007/0246407 | A1 | 10/2007 | Richards et al. | |
| 2009/0084556 | A1 | 4/2009 | Richards et al. | |
| 2011/0290326 | A1* | 12/2011 | Ovland ..... | E21B 34/08 137/1 |
| 2011/0303420 | A1 | 12/2011 | Thorkildsen et al. | |
| 2012/0305243 | A1 | 12/2012 | Hallundbæk et al. | |
| 2013/0068467 | A1 | 3/2013 | Zhou | |
| 2014/0027126 | A1 | 1/2014 | Aakre et al. | |
| 2015/0027715 | A1 | 1/2015 | Tinnen et al. | |

* cited by examiner

FLOW CONTROL DEVICE

CROSS-REFERENCE TO RELATED APPLICATIONS

This application is the U.S. National Phase application of PCT Application No. PCT/EP2015/051832 filed on Jan. 29, 2015, which claims priority to U.S. Provisional Application No. 61/945,401 filed on Feb. 27, 2014 and United Kingdom Patent Application No. GB1401653.9 filed on Jan. 31, 2014, the entire contents of each of which are incorporated herein by reference.

FIELD OF THE INVENTION

The present invention relates to a flow control device and uses thereof in oil and gas operations.

BACKGROUND TO THE INVENTION

Multi-zone wellbore completions often include downhole flow control devices which assist to provide a desired inflow or outflow profile across the completion. For example, inflow control devices may be arranged to provide a greater flow restriction in high permeability formation zones relative to lower permeability zones, thus allowing a more even production profile to be achieved. Such flow control may assist to prevent or minimise early water breakthrough in some zones, for example. This concept of flow control is well known in the art, and the principles can also be utilised to provide a desired injection profile.

Problems can often occur within completion systems in the vicinity of flow control devices, such as erosion, corrosion and the like. The present inventors have recognised that one contributing factor to such issues is related to impingement of fluids exiting the device on adjacent surfaces and structures.

Further, during well shut-in conditions, there is a risk of back-flow, or cross-flow between different pressured zones through any flow control devices. Such reverse flow can potentially compromise other wellbore infrastructure, such as screens, gravel packs or the like, with the result of damaging well performance. For example, undesired flow reversal can potentially plug screens, damage the gravel pack, and damage the completion. Such damage often results in lower injection or production rates then were possible prior to the interruption of the well injection or production.

SUMMARY OF THE INVENTION

An aspect of the present invention relates to a downhole flow control device, comprising:

- a body to be secured within a wall of a tubular, wherein the body defines a flow path therethrough;
- a nozzle mounted within the body flow path; and
- a dissipation structure positioned on a first side of the nozzle, such that fluid flowing through the body in a first direction will exit the nozzle and impinge on the dissipation structure prior to exit from the flow control device.

Accordingly, when flow occurs in the first direction, fluid momentum upon exit from the nozzle may be dissipated by the dissipation structure, thus resulting in reduced momentum in the fluid exiting the flow control device. Such an arrangement may minimise the effect of the exiting fluid on adjacent surfaces and/or structures, such as surfaces of the tubular in which the downhole flow control device is secured, associated equipment such as screen material, gravel packs and the like. Such an arrangement may assist to minimise damage, such as erosion, corrosion and the like of the adjacent surfaces and/or structures.

In use, the flow control device may provide a degree of flow control of fluid either flowing into an associated tubular from an external location via the flow control device (for example in production operations), and/or fluid flowing from the associated tubular into an external location via the flow control device (for example in injection operations). In some embodiments the external location may be defined by a wellbore annulus, a subterranean formation, or the like.

The tubular may form part of a wellbore completion, such as a production completion, injection completion, multi-purpose completion or the like. The tubular may comprise a production tubular, injection tubular, casing, liner, tool body or the like.

In normal use, the flow control device may be arranged, for example oriented, relative to the associated tubular, to ensure that a desired flow direction is aligned with the first flow direction, ensuring that the desired direction of flow is achieved with fluid exiting the nozzle and impinging on the dissipation plate prior to exit from the flow control device.

The flow control device may define a flow restriction. Such a flow restriction may function to establish a back pressure in fluid flowing through the flow control device. In this way, the flow restriction may control the flow of the fluid. The flow restriction may define a fixed flow restriction.

At least a portion of the dissipation structure may be mounted within or on the body. At least a portion of the dissipation structure may be mounted within the flow path of the body. All of the dissipation structure may be mounted on or within the body.

The dissipation structure may define an impingement surface, aligned with the nozzle such that fluid exiting the nozzle will impinge on the impingement surface. The impingement surface may be planar. The impingement surface may be curved, for example convex, concave, conical, or the like.

The nozzle may define a flow axis, wherein, in use, fluid flow through the nozzle may be substantially aligned with the flow axis. The dissipation structure may deviate or deflect the flow from the flow axis following exiting from the nozzle. The dissipation structure may deflect the flow substantially radially relative to the flow axis.

At least a portion of the dissipation structure may be arranged transverse to the nozzle flow axis. For example, an impingement surface of the dissipation structure may be arranged transverse to the nozzle flow axis. Such an arrangement may facilitate impingement of fluid exiting the nozzle onto the dissipation structure, and deflection of said fluid. At least a portion of the dissipation structure, such as an impingement surface thereof, may be arranged perpendicular to the nozzle flow axis. At least a portion of the dissipation structure, such as an impingement surface thereof, may be arranged obliquely relative to the nozzle flow axis.

At least a portion of the dissipation structure may be integrally formed with the body. For example, a portion of the body may be formed to define at least a portion of the dissipation structure.

At least a portion of the dissipation structure may be separately formed and mounted or secured on or within the flow control device, for example on or within the body. Such an arrangement may provide advantages in terms of ease of manufacture. Furthermore, such an arrangement may permit replacement of at least a portion of the dissipation structure, for example replacement of a damaged or worn portion of the dissipation structure or the like. Also, such an arrangement may minimise damage, such as erosion, to other portions of the flow control device, such as the body. This may prolong the life of the body, for example, and may permit its reuse. Further, providing at least a portion of the dissipation structure separately may permit substitution of the separate component or components, for example to vary the geometry within the flow control device.

The dissipation structure may comprise a dissipation insert. The dissipation insert may be arranged within the flow control device, for example within the body, to be aligned with the nozzle such that fluid exiting the nozzle will impinge on said dissipation insert.

The dissipation insert may define an impingement surface, wherein when the dissipation insert is mounted within the flow control device the impingement surface of said insert may be aligned with the nozzle such that fluid exiting the nozzle will impinge on the insert impingement surface.

The dissipation insert may be mounted within a dissipation pocket formed within the body.

The dissipation insert may be secured to the body by one or more of interference fitting, threaded connection, adhesive bonding, profiled interconnection, welding, bolting or the like.

The dissipation structure may comprise a base member, wherein said base member supports the dissipation insert. The base member may define a pocket for receiving the dissipation insert. The base member may be integrally formed with the body. Alternatively, the base member may be separately formed from the body, and secured thereto.

The dissipation insert may comprise a different material from the body. For example, the dissipation insert may comprise a hard material, providing additional resistance to erosion relative to the material of the body. The dissipation insert may comprise a tungsten carbide material, for example. It should be understood that any suitable dissipation insert material may be utilised as readily selected by a person of skill in the art.

The dissipation insert may comprise a disk. Such a disk may be mountable within a cylindrical pocket formed on the body.

The flow control device may comprise or define at least one flow port which receives fluid from the dissipation structure, to permit said fluid to exit the flow control device. In such an arrangement, the flow port may define an exit flow port during fluid flow in the first direction. During reverse flow, for example in an opposite, second direction, the flow port may define an inlet flow port.

At least one flow port may extend or face axially relative to the flow control device. In one embodiment at least one axial flow port may be provided within an end face of the flow control device. Such an arrangement may permit flow to/from the flow control device in a generally axial direction.

At least one flow port may extend or face radially relative to the flow control device. In one embodiment at least one radial flow port may be provided within a cylindrical side wall of the flow control device. Such an arrangement may permit flow to/from the flow control device in a generally radial direction.

At least one flow port may be defined by or within the body.

At least one flow port may be defined by or within the dissipation structure.

At least one flow port may be defined between the body and the dissipation structure.

A single flow port may be provided. Alternatively, a plurality of flow ports may be provided.

A plurality of flow ports may be arranged circumferentially relative to the dissipation structure. For example, a plurality of flow ports may be arranged circumferentially around the dissipation structure. In such an arrangement, the dissipation structure may be arranged to radially deflect flow from the nozzle flowing in the first direction, such that said flow is distributed radially outwardly towards the circumferentially arranged flow ports, to exit the flow control device.

In some embodiments the flow control device may permit flow reversal, such that flow may be permitted in a second direction, which is opposite to the first direction.

The flow control device may define a fixed geometry. In such an arrangement, the geometry may not change or vary during use. For example, the flow control device may be arranged such that variations in fluid or flow conditions during use, such as variations in flow direction, may not alter the geometry of the flow control device. As such, the geometry may be fixed independently of any flow condition through the device. This may, for example, readily permit the flow control device to accommodate reverse flow through the flow control device. That is, as the flow control device defines a fixed geometry, no changes in the ability to flow through the flow control device in reverse directions should result.

The dissipation structure may be fixed relative to the nozzle, for example spatially fixed relative to the nozzle. The dissipation structure may be fixed relative to the nozzle, irrespective of fluid flow. Thus, any change in flow direction, for example from the first to second direction, preferably will not change the relative spacing between dissipation structure and nozzle, such that flow reversal may be permitted.

The flow control device may comprise a first dissipation structure provided on a first side of the nozzle. In such an arrangement fluid flowing through the body in the first direction will exit the nozzle and impinge on the first dissipation structure prior to exit from the flow control device.

The flow control device may comprise a second dissipation structure provided on a second side of the nozzle, which is opposite to the first side. In such an arrangement fluid flowing through the body in a second direction, opposite to the first direction, will exit the nozzle and impinge on the second dissipation structure prior to exit from the flow control device. Such an arrangement may provide fluid momentum dissipation during flow in reverse directions. Such an arrangement may permit the flow control device to function universally, for example to accommodate both inflow and outflow relative to the associated tubular.

The form of the second dissipation structure may be as defined according to any above described dissipation structure.

The nozzle may define an inlet into the body flow path. In some embodiments during flow reversal the nozzle may define an outlet from the body flow path.

The nozzle may be arranged within the body such that all flow through the flow path of the body flows through the nozzle.

The nozzle may be arranged to provide a desired flow control to fluid flowing through the device. The nozzle may be arranged to provide a restriction to fluid flow. Such a restriction to fluid flow may establish a desired backpressure within the fluid.

The nozzle may comprise an orifice. The orifice may establish a desired restriction to fluid flow. The orifice may be sized to control flow therethrough.

The nozzle may define a fixed fluid restriction.

The nozzle may comprise or define at least one nozzle port to permit fluid communication with the body flow path. In some embodiments a single nozzle port may be provided. In other embodiments multiple nozzle ports may be provided.

The nozzle may comprise a fluid restriction within or associated with at least one nozzle port. The nozzle may comprise an orifice within or associated with at least one nozzle port.

The flow control device may comprise flow direction control arrangement. The flow direction control arrangement may be arranged to permit flow through the device in a desired direction, for example in only one direction. Such uni-directional flow control may minimise the risk of undesired flow reversal through the device. This may assist to prevent damage, for example, to any associated equipment or infrastructure, such as screens, gravel packs and the like.

The flow direction control arrangement may be associated with the nozzle. In some embodiments the flow direction control arrangement may form part of, for example an integral part of, the nozzle.

The flow direction control arrangement may comprise a one way valve arrangement.

The one way valve arrangement may comprise a check valve arrangement.

The one way valve arrangement may comprise a valve member configured to selectively block, or restrict, a nozzle port within the nozzle.

In one embodiment, a nozzle port provided within the nozzle may define or comprise a valve seat, and the flow direction control arrangement may comprise a valve member configured to selectively engage the valve seat. The valve member may be lifted from the valve seat to permit flow in a first direction, and may engage the valve seat to prevent flow in a second, opposite direction.

The valve member may be moved relative to the valve seat in accordance with flow direction. The valve member may be moved relative to the valve seat in accordance with a pressure differential across the valve seat.

The valve member may comprise a ball, disk, poppet or the like.

The valve member may cooperate with the valve seat to provide a flow restriction. Such an arrangement may provide a variable flow restriction.

The nozzle may comprise a plurality of nozzle ports, wherein two or more of said nozzle ports comprise a valve seat, and the device comprises one or more valve members for cooperating with the respective valve seats. In some embodiments a single valve member may cooperate with multiple valve seats. In other embodiments a single valve member may cooperate with a single valve seat. In some embodiments all nozzle ports are associated with a valve member.

The flow direction control arrangement may comprise a biasing arrangement for biasing the valve member in a desired direction, for example in a direction to engage a valve seat. In such an arrangement the valve member must be moved against this bias to be lifted from the valve seat.

The biasing arrangement may comprise a spring biasing arrangement.

In one embodiment the dissipation structure defines or comprises a biasing arrangement for biasing a valve member. For example, at least a portion of the dissipation structure, for example a dissipation insert, may be mounted on a biasing structure, and arranged to act against the valve member. In such an arrangement, the effect of the biasing structure may act on the valve member via the dissipation structure.

The biasing structure may comprise a spring, such as a wave spring, Belleville spring, coil spring or the like.

At least a portion of the nozzle may be integrally formed with the body.

At least a portion of the nozzle may be separately formed and subsequently secured to the body. Such an arrangement may provide advantages in terms of ease of manufacture. Furthermore, such an arrangement may permit replacement of the nozzle, for example replacement of a damaged or worn nozzle, substitution for a nozzle with a different geometry, for example to provide a different flow control or the like. Also, such an arrangement may minimise damage, such as erosion, to the body. This may prolong the life of the body, and may permit its reuse.

In one embodiment the nozzle may comprise a nozzle insert. The nozzle insert may be mounted within the body. The nozzle insert may be mounted within a nozzle pocket formed within the body. The nozzle inset may comprise or define an orifice.

The nozzle insert may be secured to the body by one or more of interference fitting, threaded connection, welding, bolting or the like.

The nozzle insert may be sealably mounted within the body. Such an arrangement may ensure all fluid flow through the body passes through the nozzle.

The nozzle insert may comprise a different material from the body. For example, the nozzle insert may comprise a hard material, providing additional resistance to erosion relative to the material of the body. The nozzle insert may comprise a tungsten carbide material, for example. It should be understood that any suitable nozzle insert material may be utilised as readily selected by a person of skill in the art.

In some embodiments at least a portion of the nozzle and dissipation structure may be defined on a common insert mounted or mountable within the body.

The body may be threadedly securable within the wall of a tubular. In one embodiment the body may comprise a threaded structure, such as a male threaded structure, to cooperate with a threaded structure, such as a female threaded structure, provided in a wall of a tubular.

The body may comprise a sealing arrangement configured to provide sealing between the body and a tubular. The seal arrangement may comprise, for example, an O-ring or the like.

The body may define one or more engagement structures to facilitate engagement with tooling to assist with securing of the body within a wall of a tubular.

The flow control device may define or function as an inflow control device (ICD).

The flow control device may define or function as an outflow control device.

In use, multiple flow control devices may be provided along a wellbore completion system, to accommodate inflow and/or outflow relative to the completion system. Two or more flow control devices may be configured to provide different levels of flow control. For example, two or more flow control devices may be configured to provide different flow restrictions. Such different flow restrictions may be achieved by included different nozzles within at least two of the flow control devices. This arrangement may permit an operator to control an inflow and/or outflow profile along a portion of the completion system.

An aspect of the present invention relates to a downhole flow control arrangement, comprising:

a downhole tubular defining a port in a wall thereof;

a flow control device according to any other aspect secured within the port in the wall of the tubular.

The flow control arrangement may comprise a screen material surrounding the downhole tubular.

The downhole flow control arrangement may form part of a wellbore completion system.

The downhole flow control arrangement may comprise a valve assembly for use in selectively opening the flow control device. Such a valve assembly may comprise a sleeve slidably mounted relative to the tubular. Shifting of the valve sleeve may selectively open the flow control device.

The downhole tubular may comprise a plurality of ports arranged axially along said tubular, wherein each port includes a flow control device. Two or more flow control devices may be configured to provide different levels of flow control. For example, two or more flow control devices may be configured to provide different flow restrictions. Such different flow restrictions may be achieved by included different nozzles within at least two of the flow control devices. This arrangement may permit an operator to control an inflow and/or outflow profile along a portion of the completion system.

An aspect of the present invention relates to a downhole flow control method, comprising:

arranging a flow control device in a wall of a tubular, wherein the flow control device comprises a nozzle and a dissipation structure located on one side of the nozzle;

permitting flow through a nozzle in a first direction such that fluid exiting the nozzle impinges on the dissipation structure prior to exit from the flow control device.

The method may be performed utilising a flow control device according to any other aspect of the present invention.

The method may comprise permitting flow through the nozzle in a second direction, which is opposite to the first direction.

The method may comprise providing a further dissipation structure on an opposite side of the nozzle, such that during flow in the second direction fluid will exit the nozzle and impinge on the further dissipation structure, prior to exiting the flow control device.

A further aspect of the present invention relates to a downhole flow control arrangement, comprising:

a tubular member defining a longitudinal axis and a flow path through a wall thereof, wherein the flow path extends obliquely relative to the longitudinal axis; and a flow control device mounted within the flow path.

In use, fluid flowing through the flow port may flow along a flow axis which is obliquely aligned relative to the longitudinal axis of the tubular. Such an arrangement may assist to minimise the effect of fluid impingement of the fluid on surrounding surfaces and/or structures following exit from the flow port. For example, the oblique flow direction provided by the obliquely aligned flow port may result in minimising fluid momentum/energy when said fluid might impinge on surrounding surfaces and/or structures.

The flow control device may be integrally formed within the flow path.

The flow control device may be separately formed and mounted or secured within the flow path of the tubular member.

The flow control device may be configured to provide a back pressure in fluid flowing therethrough.

The flow control device may comprise a nozzle structure configured to provide a restriction to fluid flow therethrough.

The flow control device may comprise a flow control device according to any other aspect.

The flow path may extend obliquely relative to the longitudinal axis of the tubular in a direction of intended fluid flow along said tubular.

The flow control arrangement may comprise a port member secured to the tubular member, wherein the flow path extends continuously through the port member and the wall of the tubular at an oblique angle. In such an arrangement the flow path through both the port member and the tubular may be formed by drilling.

The port member may be secured to the tubular member by any suitable means, such as by welding, threaded connection, adhesive bonding, or the like.

The flow control arrangement may comprise a plurality of flow paths through the wall of the tubular. The plurality of flow paths may be arranged circumferentially around the tubular member. Each flow path may comprise a flow control device.

The flow control arrangement may comprise a screen material surrounding the tubular in the vicinity of the flow path.

An aspect of the present invention relates to a downhole flow control device, comprising:

a body to be secured within a wall of a tubular, wherein the body includes a fluid inlet and a fluid outlet;

a nozzle positioned intermediate the body fluid inlet and body fluid outlet; and a dissipation structure positioned intermediate the nozzle and the fluid outlet of the body, such that, in use, fluid from the nozzle impinges on the dissipation structure prior to exit from the body.

An aspect of the present invention relates to a downhole flow control device, comprising:

a body to be secured within a wall of a tubular, wherein the body defines a fluid inlet and a fluid outlet; and a one way valve arrangement associated with the fluid inlet of the body.

In use, the body may be secured within the wall of a tubular, such that fluid is permitted to flow through the body in the desired direction, to allow fluid communication to or from the tubular, depending on the orientation of the device.

The one way valve arrangement may facilitate uni-directional flow control through the device from the fluid inlet to the fluid outlet. Such uni-directional flow control may minimise the risk of undesired flow reversal through the device, for example in the event of a well shut-in event. This may assist to prevent damage, for example, to any associated equipment or infrastructure, such as screens, gravel packs and the like.

The flow control device may define a flow restriction. Such a flow restriction may function to establish a back pressure in fluid flowing through the flow control device. In this way, the flow restriction may control the flow of the fluid. The flow restriction may define a fixed flow restriction.

The flow control device may comprise a nozzle mounted within or on the body. The nozzle may define the fluid inlet of the body.

The nozzle may be arranged within or on the body such that all flow through the body flows through the nozzle.

The nozzle may be arranged to provide a desired flow control to fluid flowing through the device. The nozzle may be arranged to provide a restriction to fluid flow. Such a restriction to fluid flow may establish a desired backpressure within the fluid.

The nozzle may comprise an orifice. The orifice may establish a desired restriction to fluid flow. The orifice may be sized to control flow therethrough.

The nozzle may define a fixed fluid restriction.

The nozzle may comprise or define at least one nozzle port to permit fluid communication with the body flow path. In some embodiments a single nozzle port may be provided. In other embodiments multiple nozzle ports may be provided.

The nozzle may comprise a fluid restriction within or associated with at least one nozzle port. The nozzle may comprise an orifice within or associated with at least one nozzle port.

The one way valve arrangement may be associated with the nozzle. In some embodiments the one way valve arrangement may form part of, for example an integral part of, the nozzle.

The one way valve arrangement may comprise a check valve arrangement.

The one way valve arrangement may comprise a valve member configured to selectively block, or restrict, a nozzle port within the nozzle.

In one embodiment, a nozzle port provided within the nozzle may define or comprise a valve seat, and the valve arrangement may comprise a valve member configured to selectively engage the valve seat. The valve member may be lifted from the valve seat to permit flow in a first direction, and may engage the valve seat to prevent flow in a second, opposite direction.

The valve member may be moved relative to the valve seat in accordance with direction of flow. The valve member may be moved relative to the valve seat in accordance with a pressure differential across the valve seat.

The valve member may comprise a ball, disk, poppet or the like.

The valve member may cooperate with the valve seat to provide a flow restriction. Such an arrangement may provide a variable flow restriction.

The nozzle may comprise a plurality of nozzle ports, wherein two or more of said nozzle ports comprise a valve seat, and the device comprises one or more valve members for cooperating with the respective valve seats. In some embodiments a single valve member may cooperate with multiple valve seats. In other embodiments a single valve member may cooperate with a single valve seat. In some embodiments all nozzle ports are associated with a valve member.

The one way valve arrangement may comprise a biasing arrangement for biasing the valve member in a desired direction, for example in a direction to engage a valve seat. In such an arrangement the valve member must be moved against this bias to be lifted from the valve seat.

The biasing arrangement may comprise a spring biasing arrangement.

In one embodiment the biasing arrangement may comprise an activating structure which engages one or move valve members to bias said valve members in a desired direction. The activating structure may be acted upon by a biasing structure, such that the biasing structure indirectly acts on the one or more valve members via the activating structure. The biasing structure may comprise a spring, such as a wave spring, Belleville spring, coil spring or the like.

The activating structure may comprise a plate structure, such as a disk. The activating structure may define or form part of a dissipation structure. Such a dissipation structure may function as defined in any other aspect. Furthermore, such a dissipation structure may be provided as defined in relation to any other aspect.

The flow control device may comprise or define at least one outlet flow port to permit said fluid to exit the flow control device.

At least one outlet flow port may extend or face axially relative to the flow control device. In one embodiment at least one axial flow port may be provided within an end face of the flow control device. Such an arrangement may permit flow to/from the flow control device in a generally axial direction.

At least one outlet flow port may extend or face radially relative to the flow control device. In one embodiment at least one radial flow port may be provided within a cylindrical side wall of the flow control device. Such an arrangement may permit flow to/from the flow control device in a generally radial direction.

At least one outlet flow port may be defined by or within the body.

A single outlet flow port may be provided. Alternatively, a plurality of outlet flow ports may be provided.

It should be understood that the features defined in relation to one aspect may be applied or provided in combination with any other aspect. For example, any defined methods of operation of a tool, apparatus or system disclosed herein may relate to operational steps with a method or process.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
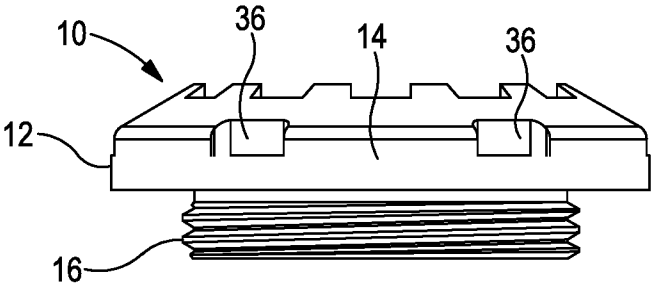
FIG. 1 is a side view of a flow control device according to one embodiment of the present invention.

FIG. 1 provides a side view of a downhole flow control device, generally identified by reference numeral 10, in accordance with an embodiment of the present invention. As will be described in further detail below the device 10 may be secured within the wall of a downhole tubular, such as a completion tubular, for use in providing a degree of flow control during inflow and/or outflow relative to the tubular.

The flow control device 10 comprises a metal body 12 with an integrally formed head portion 14 and threaded portion 16. The threaded portion 16 facilitates connection within a threaded port in the side of a tubular member, as will be described in further detail below.

Figure 2:
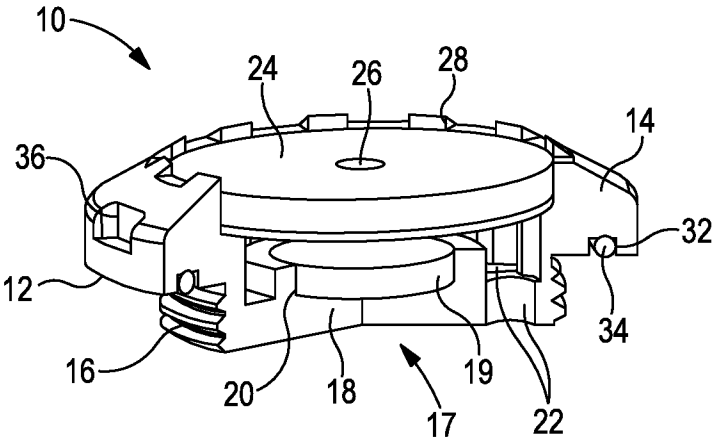
FIG. 2 is partially cut-away perspective view of the flow control device of FIG. 1.
Figure 3C:
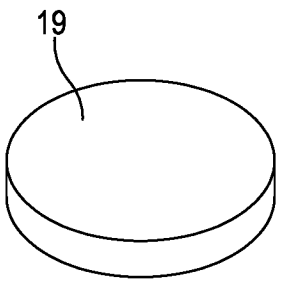
FIG. 3C is a perspective view of a dissipation plate of the flow control device of FIG. 1.
Figure 3B:
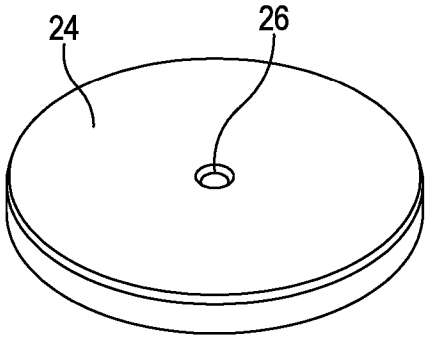
FIG. 3B is a perspective view of a nozzle of the flow control device of FIG. 1.
Figure 3A:
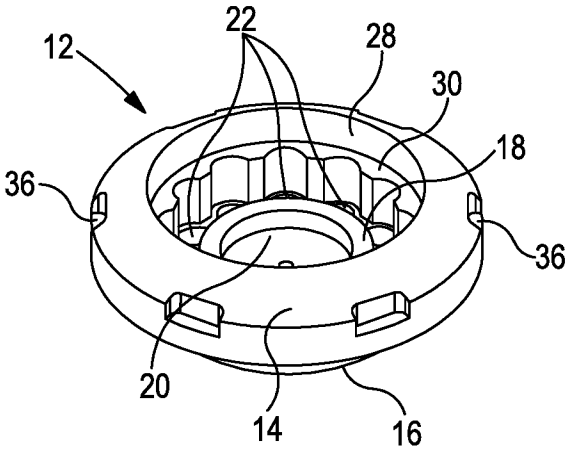
FIG. 3A is a perspective view of a body portion of the flow control device of FIG. 1.

Reference is now made to FIGS. 2 and 3A to 3C, wherein a partially cut-away perspective view of the device 10 is shown in FIG. 2, and individual components of the device 10 are illustrated in isolation in FIGS. 3A, 3B and 3C. The body 12 includes a dissipation structure 17 which comprises an integrally formed base 18 and a separate dissipation insert or disk 19 mounted within a central pocket 20 formed in the base 18. The dissipation disk 19 is formed of a hard or hardened material, such as tungsten carbide. A plurality of axial flow ports 22 are provided in the base 18 and are arranged circumferentially around the central pocket 20 and dissipation disk 19.

The device 10 further comprises a nozzle disk 24 which defines a central orifice 26, wherein the nozzle disk is mounted within an upper pocket 28 formed within the body 12. Specifically, the upper pocket 28 includes a circumferential ledge 30 which supports the peripheral underside of the nozzle disk 24.

When the nozzle disk 24 is installed, the dissipation structure 17 and nozzle disk are spatially fixed relative to each other. In this respect, no variations in the spatial arrangement between the dissipation structure 17 and the nozzle disk 24 may occur during flow through the device 10.

The orifice 26 of the nozzle 24 defines an inlet to the flow control device 10. In this respect the orifice 26 is sized to provide a desired flow restriction to provide a degree of flow control to fluid flowing therethrough. For example, the orifice 26 may be sized to provide a desired fluid backpressure.

When assembled, the orifice 26 is aligned with the dissipation disk 19 such that fluid exiting the nozzle will impinge onto the dissipation disk, and be radially deflected towards the axial flow ports 22 to exit the device 10. Accordingly, the dissipation structure 17 functions to reduce the fluid momentum prior to exit from the device 10. This is intended to minimise any detrimental effect, such as erosion and/or corrosion, of the exiting fluid on surfaces or structures in the vicinity of the flow control device 10.

The provision of a separate dissipation disk 19 may permit said disk to be readily replaced, for example following damage by erosion or the like. In this way, the dissipation disk 19 will provide a degree of protection to the body 12, thus allowing the body 12 to be reused.

Furthermore, the provision of a separate nozzle disk 24 may also allow this component to be readily replaced, for example due to damage or the like. Also, in this case the nozzle 24 may be readily substituted for another, for example to readily change the orifice dimensions 26. Also, in some cases flow control might not necessarily be required, and as such a device 10 may be installed without the nozzle disk 24 in place.

The head portion 14 of the device includes a circumferential recess 32 on an underside thereof to accommodate an O-ring seal 34. As will be described in more detail below, the O-ring 34 is provided to achieve sealing between the device 10 and a tubular member.

The head portion 14 further comprises a plurality of tool interface profiles 36 which permit a tool (not shown), such as a wrench, to screw the device into a threaded port in a tubular member.

Figure 4:
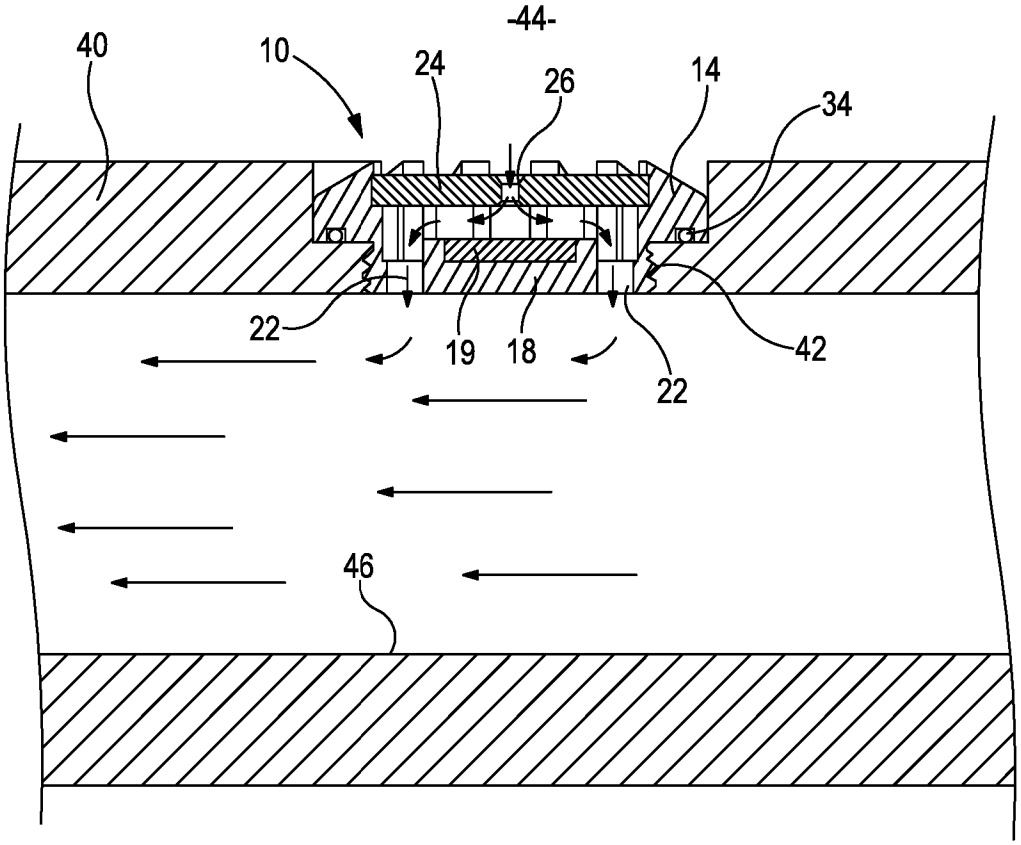
FIG. 4 is a diagrammatic illustration of the flow control device of FIG. 1 when in use.

Reference is now made to FIG. 4 which is a cross-sectional view of a tubular member 40 which includes the flow control device 10 mounted therein. Specifically, the device 10 is threadedly secured within a threaded port 42 through a side wall of the tubular member 40, wherein the O-ring 34 of the device 10 sealingly engages a surface of the tubular 40. In the present illustrated embodiment the flow control device 10 is arranged within the tubular to accommodate inflow into the tubular 40 from an external location 44, which may be a wellbore annulus. The inflow direction may be an example of flow in a first direction. The fluid in the embodiment may comprise a hydrocarbon, such as oil.

Thus, during inflow, as illustrated by the arrows, fluid will enter the device 10 via the orifice 26 in the nozzle 24, thus creating a backpressure within the external location 44. This backpressure may provide a desired inflow control. The fluid will exit the orifice 26 and impinge upon the dissipation plate 19 of the dissipation structure 17, thus effectively providing a reduction in fluid momentum and energy. The fluid is then diverted radially outwardly to exit the device 10 via the axial flow ports 22, and into the tubular 40. As the momentum of the fluid has been reduced prior to exit from the device 10, surfaces of the tubular, such as the diametrically opposed tubular surface 46, may be protected from high energy fluid impingement thereon which could otherwise cause damage, such as by erosion or the like.

If ever necessary, the flow control device 10 is capable of accommodating reverse outflow, which may be an example of flow in a second direction.

Although a single flow control device 10 is illustrated in FIG. 4, in other arrangements a plurality of such devices may be installed within the tubular 40, for example circumferentially arranged around the tubular 40.

Figure 5:
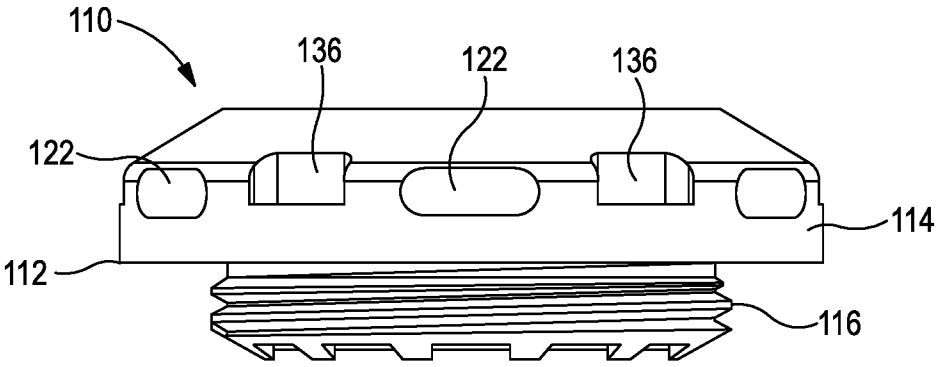
FIG. 5 is a side view of a flow control device according to an alternative embodiment of the present invention.
Figure 6:
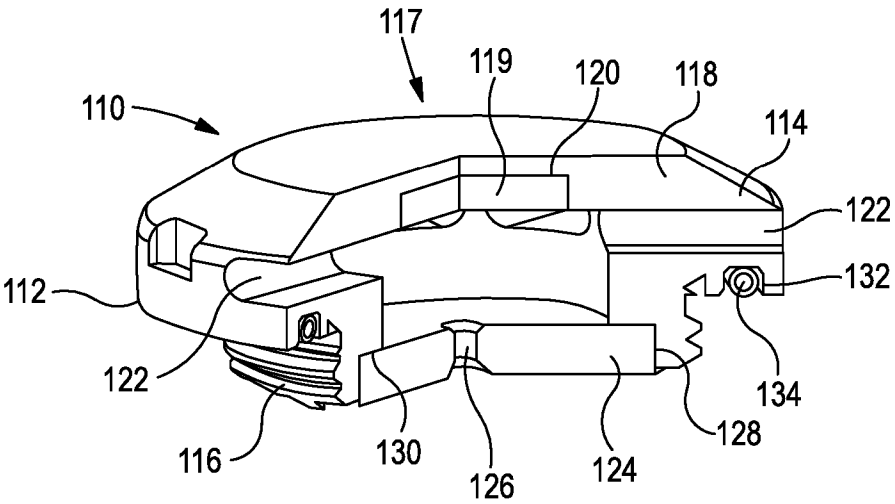
FIG. 6 is partially cut-away perspective view of the flow control device of FIG. 5.

An alternative embodiment of a flow control device, generally identified by reference numeral 110, will now be described with reference to FIGS. 5 and 6, wherein FIG. 5 is a side view of the device 110, and FIG. 6 is a partially cut-away perspective view.

The device 110 is similar to the device 10 first shown in FIG. 1, and as such like features share reference numerals, incremented by 100. As such, the device 110 includes a metal body 112 including a head portion 114 and a threaded portion 116 for facilitating connection within a wall of a tubular member. The head portion 114 includes a plurality of tool engagement profiles 136, and also defines a circumferential recess 132 and O-ring 134 therein to provide sealing with a tubular member.

The device 110 comprises a dissipation structure 117, in this case provided within the head portion 114, and includes an integrally formed base 118 and a separate dissipation insert or disk 119 mounted within a central pocket 120 formed in the base 118. The dissipation disk 119 is formed of a hard or hardened material, such as tungsten carbide. A plurality of radial flow ports 122 are arranged circumferentially around the head portion 114.

The device 110 further comprises a nozzle disk 124 which defines a central orifice 126, wherein the nozzle disk 124 is mounted within a lower pocket 128 formed within the body 112. Specifically, the lower pocket 128 includes a circumferential ledge 130 against which ledge 130 the peripheral underside of the nozzle disk 124 is engaged.

When assembled, the orifice 126 is aligned with the dissipation disk 119 such that fluid exiting the nozzle 124 will impinge onto the dissipation disk 119, and be radially deflected towards the radial flow ports 122 to exit the device 110. Accordingly, the dissipation structure 117 functions to reduce the fluid momentum/energy prior to exit from the device 110. This is intended to minimise any detrimental effect, such as erosion and/or corrosion, of the exiting fluid on surfaces or structures in the vicinity of the flow control device 10.

Figure 7:
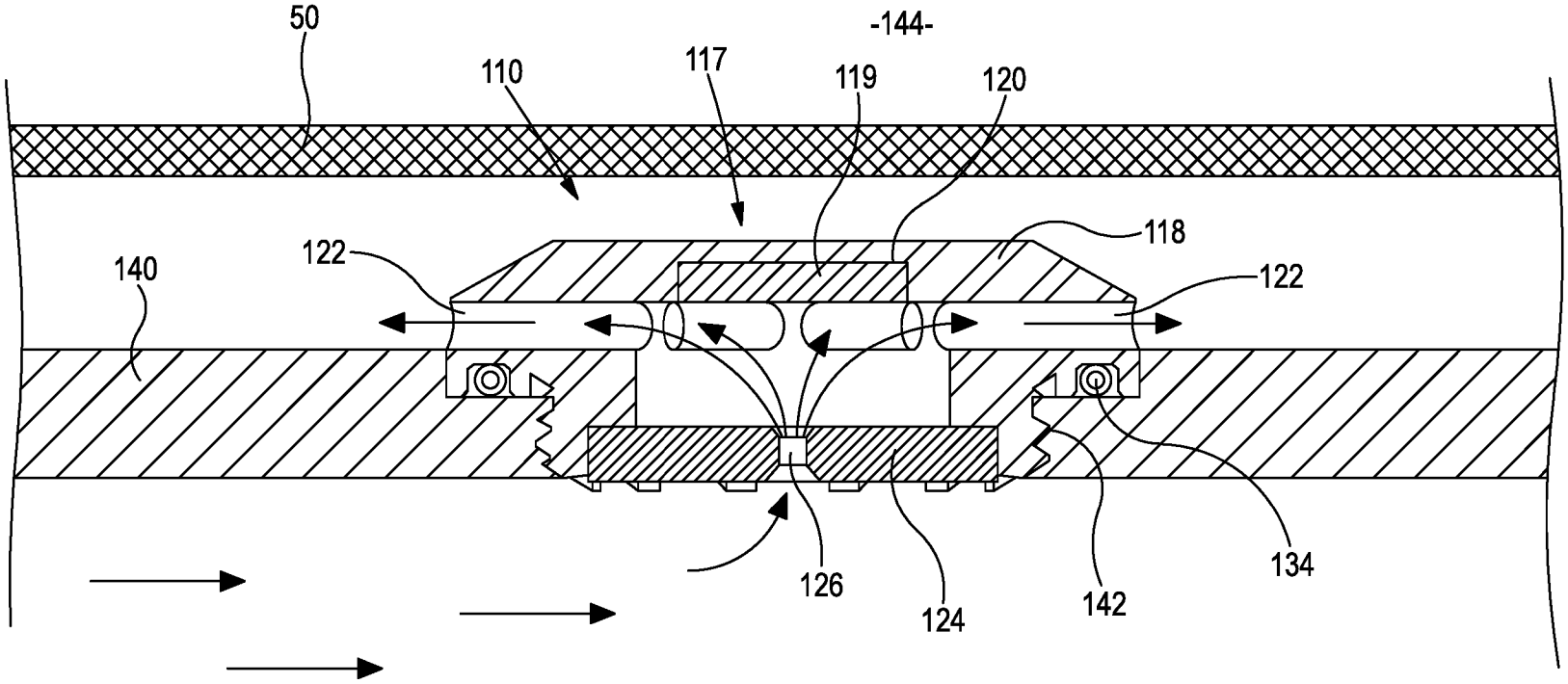
FIG. 7 is a diagrammatic illustration of the flow control device of FIG. 4 when in use.

Reference is now made to FIG. 7 which is a cross-sectional view of a tubular member 140 which includes the flow control device 110 mounted therein. Specifically, the device 110 is threadedly secured within a threaded port 142 through a side wall of the tubular member 140, wherein the O-ring 134 of the device 110 sealingly engages a surface of the tubular 140. In the present illustrated embodiment the flow control device 110 is arranged within the tubular 140 to accommodate outflow from the tubular 140 to an external location 144, which may be a wellbore annulus. In the present embodiment the outflow direction may be an example of flow in a first direction. The fluid in the embodiment may comprise an injection fluid, such as water, acid or the like.

In the present embodiment a screen material 50 surrounds the tubular member in the region of the flow control device 110.

During outflow, as illustrated by the arrows, fluid will enter the device 110 via the orifice 126 in the nozzle 124. The fluid will exit the orifice 126 and impinge upon the dissipation plate 119 of the dissipation structure 117, thus effectively providing a reduction in fluid momentum and energy. The fluid is then diverted radially outwardly to exit the device 110 via the radial flow ports 122, and into the external space 144. As the momentum of the fluid has been reduced prior to exit from the device 110, surrounding surfaces and/or structures, such as the screen material 50, may be protected from high energy fluid impingement thereon which could otherwise cause damage, such as by erosion or the like.

If ever necessary, the flow control device 110 is capable of accommodating reverse inflow, which in the present embodiment may be an example of flow in a second direction.

A further alternative embodiment of a flow control device, generally identified by reference numeral 210, will now be described with reference to FIG. 8, which is a diagrammatic cross-sectional view of the device 210.

The device 210 is similar to the device 10 first shown in FIG. 1, and as such like features share reference numerals, incremented by 200. As such, the device 210 includes a body 212 within which is mounted a nozzle disk 224 which includes an orifice 226.

In this embodiment a first dissipation structure 217*a* is mounted on a first side of the nozzle 224, and a second dissipation structure 217*b* is mounted on a second side of the nozzle 224, opposite the first side. As will be described in more detail below, this embodiment accommodates reverse flow through the device 210, which provides momentum/energy dissipation to the flow in both directions.

Each dissipation structure 217*a*, 217*b* includes a base 218*a*, 218*b* and a separate dissipation insert or disk 219*a*, 219*b* mounted within a central pocket 220*a*, 220*b* formed in the base 218*a*, 218*b*. A plurality of axial flow ports 222*a* are associated with the first dissipation structure 217*a*, and a plurality of radial flow ports 222*b* are associated with the second dissipation structure 217*b*.

In use, during flow in a first direction, as illustrated by arrow 52, fluid will enter the device 210 via the radial flow ports 222*b*, will flow through the orifice 226 of the nozzle 224 and exit to impinge on the dissipation disk 219*a* of the first dissipation structure 217*a*. The fluid will then exit the device 210 via the axial flow ports 222*a*.

During flow in a reverse second direction, as illustrated by arrow 54, fluid will enter the device 210 via the axial flow ports 222*a*, will flow through the orifice 226 of the nozzle 224 and exit to impinge on the dissipation disk 219*b* of the second dissipation structure 217*b*. The fluid will then exit the device 210 via the radial flow ports 222*b*.

Figure 8:
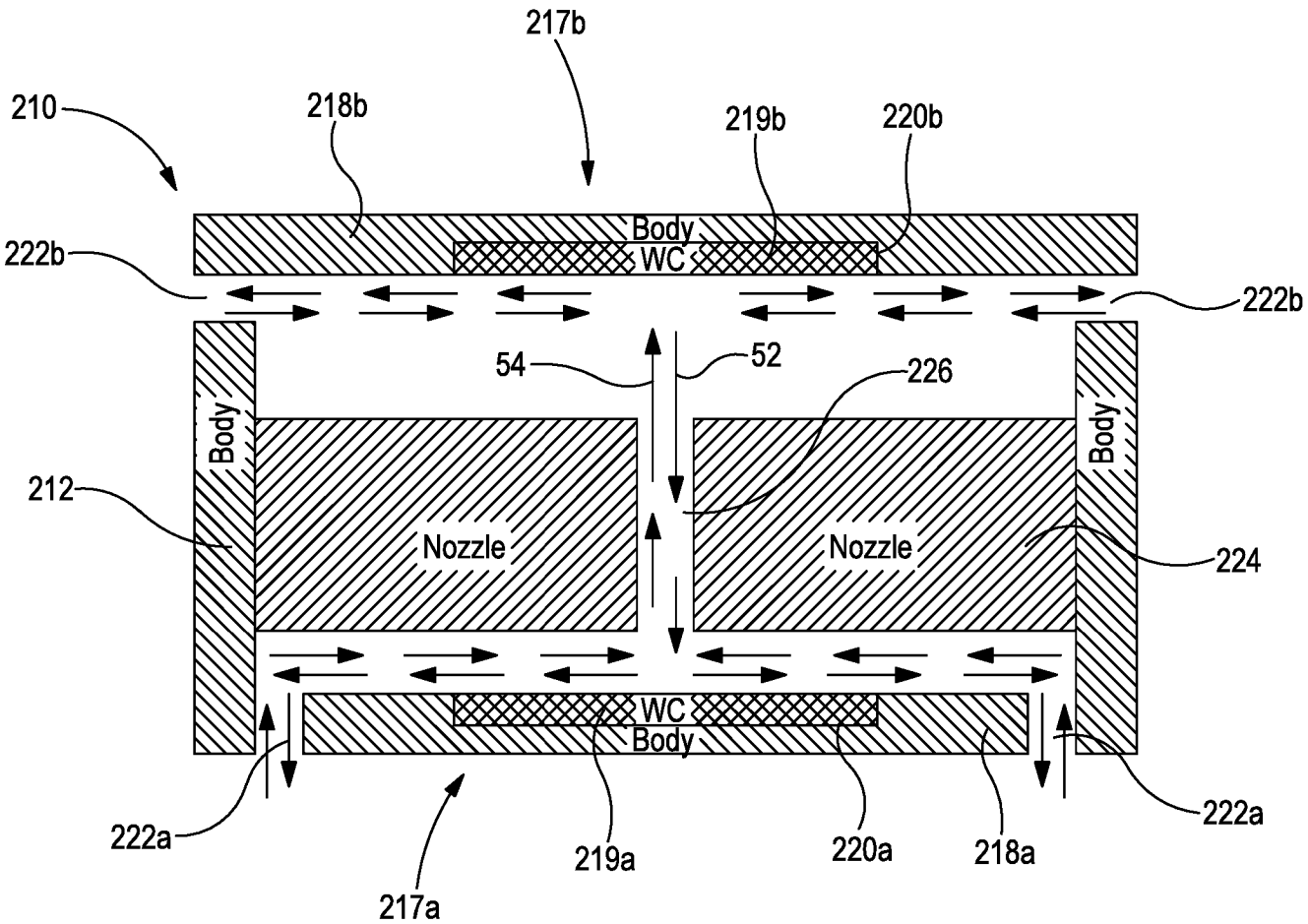
FIG. 8 is a diagrammatic illustration of a flow control device according to an alternative embodiment of the present invention.

Although a combination of axial and radial flow ports 222*a*, 222*b* may be utilised, as illustrated in FIG. 8, in other embodiments only radial or only axial ports may be present.

Figure 10:
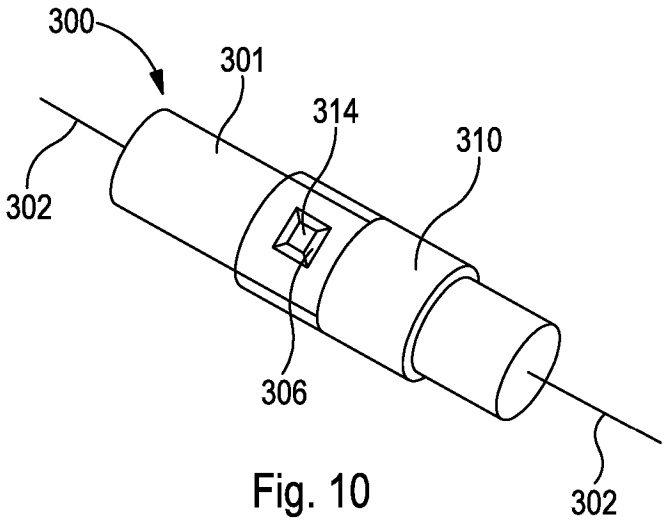
FIG. 10 is a diagrammatic perspective view of the flow control arrangement of FIG. 9.
Figure 9:
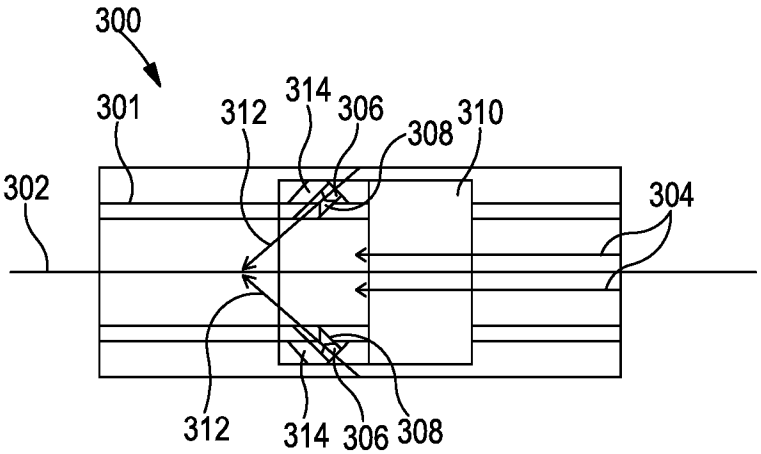
FIG. 9 is a diagrammatic cross-sectional view of a flow control arrangement according to an embodiment of the present invention.

A flow control arrangement, generally identified by reference numeral 300, according to an embodiment of the present invention will now be described with reference to FIGS. 9 and 10, wherein FIG. 9 provides a diagrammatic cross-sectional illustration of the flow control arrangement 300, and FIG. 10 provides a diagrammatic perspective view of the flow control arrangement 300.

The flow control arrangement comprises a tubular member 301 which defines a longitudinal axis 302, wherein flow through the tubular 301, as illustrated by arrows 304 is aligned with the longitudinal axis 302.

A plurality (two in the embodiment shown) of flow paths 306 extend through the wall of the tubular 301, wherein the flow paths 306 are aligned at an oblique angle relative to the tubular axis 302. A flow control device in the form of a nozzle 308 is provided in each flow path 306. Further, a sand screen 310 is provided around the outer surface of the tubular, to restrict the flow of sand and other particulate material into the tubular 301.

In use, fluid flowing through the flow ports 306 will flow along a flow axis, illustrated by arrows 312, which is obliquely aligned relative to the longitudinal axis 302 of the tubular 301. Such an arrangement may assist to minimise the effect of fluid impingement of the fluid on surrounding surfaces and/or structures following exit from the flow port. For example, the oblique flow direction provided by the obliquely aligned flow ports 306 may result in minimising fluid momentum/energy when said fluid might impinge on surrounding surfaces and/or structures.

Each flow port 306 in the present embodiment is formed by first providing a port member 314 on an outer surface of the tubular 301, secured for example by welding. The flow ports 306 are then drilled through the port members 314 and the wall of the tubular 301 at the required oblique angle.

Figure 12:
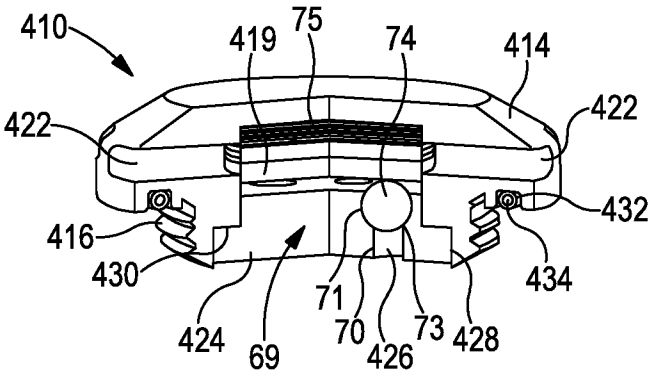
FIG. 12 is a partially cut-away perspective view of the flow control device of FIG. 11.
Figure 11:
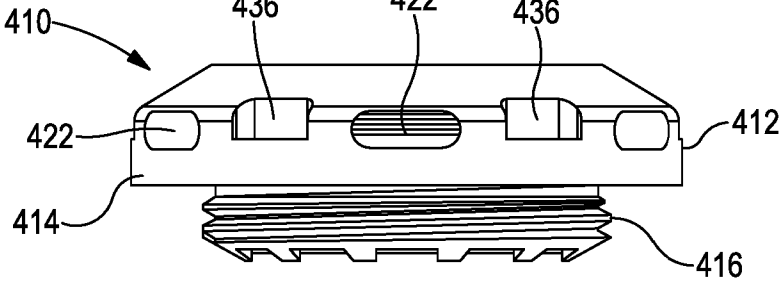
FIG. 11 is a side view of a flow control device according to a further alternative embodiment of the present invention.
Figure 13:
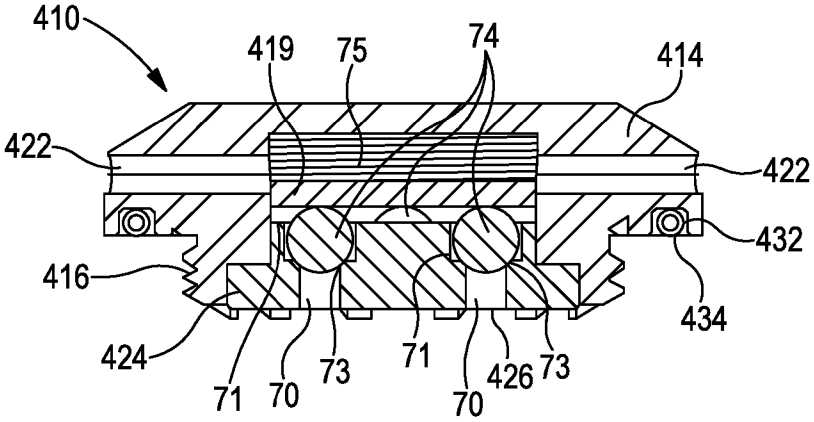
FIG. 13 is a cross-sectional view of the device of FIG. 11.

An alternative embodiment of a flow control device, generally identified by reference numeral 410, will now be described with reference to FIGS. 11, 12 and 13, wherein FIG. 11 is a side view of the device 410, FIG. 12 is a partially cut-away perspective view, and FIG. 13 is a cross-sectional view.

The device 410 is similar to the device 10 first shown in FIG. 1, and as such like features share reference numerals, incremented by 400. As such, the device 410 includes a metal body 412 including a head portion 414 and a threaded portion 416 for facilitating connection within a wall of a tubular member. The head portion 414 includes a plurality of tool engagement profiles 436, and also defines a circumferential recess 432 and O-ring 434 therein to provide sealing with a tubular member. A plurality of radial outlet flow ports 422 are arranged circumferentially around the head portion 414.

The device 410 further comprises a nozzle disk 424 which defines a plurality of inlet flow ports 426, evenly distributed circumferentially around the nozzle disk 424, wherein the nozzle disk 424 is mounted within a lower pocket 428 formed within the body 412. Specifically, the lower pocket 428 includes a circumferential ledge or stepped portion 430 against which ledge 430 a corresponding stepped region of the nozzle disk 424 is engaged.

As will be described in more detail below, the device 410 includes a one way or check valve arrangement 69 which permits flow in only one direction through the device 410.

Each inlet port 426 includes a primary bore 70 and a coaxially aligned counter bore 71 of larger diameter. The step change or interface between the primary bore 70 and counter bore 71 defines a valve seat 73.

Mounted within each counter bore 71 is a ball member 74, which functions as a valve member and in use selectively engages a respective valve seat 73. In this respect, when the balls 74 engage a respective seat 73 flow through the ports 70 is prevented, and when the balls 74 are lifted from the seats 73 flow is permitted.

An activation disk member 419 is provided within the body 412, on one side of the nozzle disk 424, and engages each ball member 74. The disk 419 is mounted on a spring arrangement 75 (a wave spring in the present embodiment) which acts to bias the disk 419 to act on the balls 74, to thus bias said balls 74 towards a closed position.

In use, during flow in a first direction (due to a pressure gradient in that direction for example), the balls 74 will be lifted from their corresponding valve seats 73 against the bias of the spring 75, such that flow may continue. However, in the event of flow reversal, or a reversal in the pressure gradient, the balls 74 will close, thus preventing flow reversal.

Such an arrangement may prevent or minimise the occurrence of flow reversal in the event of, for example, a well shut-in event. This may assist to avoid or minimise losses in well performance, for example by minimising damage or disruption/clogging to other equipment or infrastructure, such as screens, gravel packs or the like.

The activation disk 419 may also function to dissipate fluid energy or momentum of the fluid flowing through the device, in a similar manner to that described above in other embodiments.

In other alternative embodiments, the device 10 first shown in FIG. 1 may be modified to include a similar one way or check valve system or arrangement.

It should be understood that the embodiments described herein are merely exemplary and that various modifications may be made thereto, without departing from the scope of the present invention.

The invention claimed is:

1. A downhole flow control device, comprising:

a body to be secured within a wall of a tubular, wherein the body defines a flow path therethrough;

a nozzle mounted within the body flow path; and a dissipation structure secured to the body and positioned on a first side of the nozzle, such that fluid flowing through the body in a first direction will exit the nozzle and impinge on the dissipation structure prior to exit from the flow control device, the dissipation structure being spatially fixed relative to the nozzle, and the dissipation structure including a dissipation insert within the flow control device, the dissipation insert also being secured to the body and being aligned with the nozzle such that fluid exiting the nozzle impinges on the dissipation insert, wherein the dissipation insert is secured so as to prevent movement relative to the body of the flow control device.

2. The downhole flow control device according to claim 1, mountable relative to the tubular such that a desired flow direction is aligned with the first direction.

3. The downhole flow control device according to claim 1, wherein the flow control device defines a flow restriction to establish a back pressure in fluid flowing through the flow control device.

4. The downhole flow control device according to claim 1, wherein at least a portion of the dissipation structure is mounted within the flow path of the body.

5. The downhole flow control device according to claim 1, wherein the dissipation structure defines an impingement surface aligned with the nozzle such that fluid exiting the nozzle will impinge on the impingement surface.

6. The downhole flow control device according to claim 1, wherein the nozzle defines a flow axis and, in use, fluid flow through the nozzle is substantially aligned with the flow axis, wherein the dissipation structure deviates or deflects the flow from the flow axis following exiting from the nozzle.

7. The downhole flow control device according to claim 6, wherein the dissipation structure deviates or deflects the flow substantially radially relative to the flow axis.

8. The downhole flow control device according to claim 6, wherein at least a portion of the dissipation structure is arranged transverse to the nozzle flow axis to facilitate impingement of fluid exiting the nozzle onto the dissipation structure, and deflection of said fluid.

9. The downhole flow control device according to claim 1, wherein at least a portion of the dissipation structure is integrally formed with the body.

10. The downhole flow control device according to claim 1, wherein at least a portion of the dissipation structure is separately formed and mounted or secured within the flow control device.

11. The downhole flow control device according to claim 1, wherein the dissipation insert defines an impingement surface, wherein when the dissipation insert is mounted within the flow control device the impingement surface of said dissipation insert is aligned with the nozzle such that fluid exiting the nozzle will impinge on the dissipation insert impingement surface.

12. The downhole flow control device according to claim 1, wherein the dissipation insert is mounted within a dissipation pocket formed within the body.

13. The downhole flow control device according to claim 1, wherein the dissipation structure comprises a base member, wherein said base member supports the dissipation insert.

14. The downhole flow control device according to claim 13, wherein the base member defines a pocket for receiving the dissipation insert.

15. The downhole flow control device according to claim 1, wherein the dissipation insert comprises a different material from the body, the different material being harder than the body.

16. The downhole flow control device according to claim 1, wherein the dissipation insert comprises a disk mountable within a cylindrical pocket formed on the body.

17. The downhole flow control device according to claim 1, comprising or defining at least one flow port which receives fluid from the dissipation structure, to permit said fluid to exit the flow control device.

18. The downhole flow control device according to claim 17, wherein the flow port defines an exit flow port during fluid flow in the first direction, and during reverse flow in an opposite, second direction, the flow port defines an inlet flow port.

19. The downhole flow control device according to claim 17, wherein at least one flow port extends or faces axially relative to the flow control device, and is provided within an end face of the flow control device.

20. The downhole flow control device according to claim 17, wherein at least one flow port extends or faces radially relative to the flow control device, and is provided within a cylindrical side wall of the flow control device.

21. The downhole flow control device according to claim 17, wherein at least one flow port is defined by or within the body.

22. The downhole flow control device according to claim 17, wherein at least one flow port is defined by or within the dissipation structure.

23. The downhole flow control device according to claim 17, wherein at least one flow port is defined between the body and the dissipation structure.

24. The downhole flow control device according to claim 17, comprising a plurality of flow ports arranged circumferentially relative to the dissipation structure.

25. The downhole flow control device according to claim 1, comprising:

a first dissipation structure provided on a first side of the nozzle such that fluid flowing through the body in the first direction will exit the nozzle and impinge on the first dissipation structure prior to exit from the flow control device; and a second dissipation structure provided on a second side of the nozzle, which is opposite to the first side, such that fluid flowing through the body in a second direction, opposite to the first direction, will exit the nozzle and impinge on the second dissipation structure prior to exit from the flow control device.

26. The downhole flow control device according to claim 1, wherein the nozzle comprises or defines at least one nozzle port to permit fluid communication with the body flow path.

27. The downhole flow control device according to claim 1, comprising a flow direction control arrangement for permitting flow through the device in a desired direction.

28. The downhole flow control device according to claim 27, wherein the flow direction control arrangement is associated with the nozzle.

29. The downhole flow control device according to claim 27, wherein the flow direction control arrangement comprises a one way valve arrangement.

30. The downhole flow control device according to claim 29, wherein the one way valve arrangement comprises a valve member configured to cooperate with a valve seat to selectively block a nozzle port within the nozzle.

31. The downhole flow control device according to claim 30, wherein the dissipation structure defines or comprises a biasing arrangement for biasing the valve member.

32. The downhole flow control device according to claim 1, wherein at least a portion of the nozzle is integrally formed with the body.

33. The downhole flow control device according to claim 1, wherein at least a portion of the nozzle is separately formed and subsequently secured to the body.

34. The downhole flow control device according to claim 1, wherein the nozzle comprises a nozzle insert mounted within a nozzle pocket formed within the body.

35. The downhole flow control device according to claim 34, wherein the nozzle insert comprises or defines an orifice.

36. The downhole flow control device according to claim 1, wherein at least a portion of the nozzle and dissipation structure are defined on a common insert mounted or mountable within the body.

37. A downhole flow control method, comprising:

arranging a flow control device in a wall of a tubular, wherein the flow control device includes a nozzle and a dissipation structure located on one side of the nozzle, the dissipation structure being secured to a body and spatially fixed relative to the nozzle, the dissipation structure including a dissipation insert arranged within the flow control device, the dissipation insert also being secured to the body and being aligned with the nozzle; and permitting flow through a nozzle in a first direction such that fluid exiting the nozzle impinges on the dissipation insert of the dissipation structure prior to exit from the flow control device, wherein the dissipation insert is secured so as to prevent movement relative to the body of the flow control device.

* * * * *